US007234200B2

(12) United States Patent
Chase

(10) Patent No.: US 7,234,200 B2
(45) Date of Patent: Jun. 26, 2007

(54) FURNITURE GLIDE ASSEMBLY

(76) Inventor: John Chase, 1919 Vinsetta Ct., Rochester, MI (US) 48306

( * ) Notice: Subject to any disclaimer, the term of this patent is extended or adjusted under 35 U.S.C. 154(b) by 0 days.

(21) Appl. No.: 10/941,162

(22) Filed: Sep. 15, 2004

(65) Prior Publication Data

US 2006/0053586 A1 Mar. 16, 2006

(51) Int. Cl.
*A47B 91/06* (2006.01)

(52) U.S. Cl. ..... 16/42 R; 16/42 T; 248/188.9

(58) Field of Classification Search ..... 16/42 R, 16/42 T; 248/677, 188.9, 346.11; 297/16.1–16.2, 297/463.1–463.2; D8/374
See application file for complete search history.

(56) References Cited

U.S. PATENT DOCUMENTS

| | | | | | |
|---|---|---|---|---|---|
| D33,589 | S | | 11/1900 | Higgins | D8/107 |
| 870,770 | A | | 11/1907 | Fuller | |
| 1,903,609 | A | * | 4/1933 | Uhl | 16/42 R |
| 2,457,723 | A | * | 12/1948 | Pura | 16/32 |
| 2,637,063 | A | * | 5/1953 | Becker | 16/42 R |
| 2,641,016 | A | * | 6/1953 | Kramcsak, Jr. | 16/39 |
| 2,644,978 | A | * | 7/1953 | Becker | 16/42 R |
| 2,687,547 | A | * | 8/1954 | Matter | 16/30 |
| D173,835 | S | | 1/1955 | Chapman et al. | D8/374 |
| 2,738,541 | A | * | 3/1956 | Thornsbury | 16/42 R |
| 2,902,794 | A | * | 9/1959 | Ehrgott | 248/188.9 |
| 3,191,213 | A | * | 6/1965 | Congdon | 16/42 R |
| 3,363,280 | A | * | 1/1968 | Le Vasseur | 16/42 R |
| 3,389,421 | A | * | 6/1968 | Wheeler | 16/42 R |
| 3,641,620 | A | * | 2/1972 | Hage | 16/19 |
| 4,731,901 | A | * | 3/1988 | Daniels | 16/42 R |
| 4,754,714 | A | * | 7/1988 | Drumm | 108/157.18 |
| 5,081,740 | A | | 1/1992 | Smith | 16/42 R |
| 5,191,676 | A | * | 3/1993 | Gerner | 16/42 T |
| 5,220,705 | A | | 6/1993 | Bushey | 16/42 R |
| D340,638 | S | | 10/1993 | Campbell | D8/374 |
| 5,426,818 | A | | 6/1995 | Bushey | 16/42 R |
| D376,753 | S | | 12/1996 | Nakamura | D8/374 |
| D383,377 | S | * | 9/1997 | Sellers | D8/374 |
| 6,324,725 | B1 | * | 12/2001 | Green | 16/42 T |
| 6,405,982 | B2 | | 6/2002 | Ferencz | 248/188.9 |
| 6,471,622 | B1 | * | 10/2002 | Hammer et al. | 482/54 |
| 6,623,082 | B1 | * | 9/2003 | Huang | 297/463.1 |
| 6,626,405 | B1 | * | 9/2003 | Keast et al. | 248/188.9 |
| D487,392 | S | * | 3/2004 | Chase | D8/374 |
| 6,754,934 | B1 | * | 6/2004 | Shiffler | 16/42 R |
| 6,883,763 | B2 | * | 4/2005 | Bosman et al. | 248/188.9 |
| 2003/0163894 | A1 | | 9/2003 | Jones et al. | 16/42 R |

FOREIGN PATENT DOCUMENTS

DE 4030557 C1 * 9/1991

* cited by examiner

*Primary Examiner*—Chuck Y. Mah
*Assistant Examiner*—Michael J. Kyle
(74) *Attorney, Agent, or Firm*—Bliss McGlynn, P.C.

(57) ABSTRACT

A glide assembly is adapted to be mounted to the free end of a leg of a piece of furniture. The glide assembly includes a body defining an exterior and a bore extending partially through the body to define a hollow interior surface and an open end of the body. An insert is removably mountable about the free end of the leg and adapted to be received through the open end and within the bore of the body so as to fixedly secure the body about the free end of the leg.

9 Claims, 1 Drawing Sheet

FURNITURE GLIDE ASSEMBLY

BACKGROUND OF THE INVENTION

1. Field of the Invention

The present invention relates, generally, to a glide that is mountable to a leg of a piece of furniture and, in particular, to a glide assembly fixedly securable about a leg of a chair or desk.

2. Description of the Related Art

The free end of each leg of a piece of furniture often includes a cap, foot, or glide to allow easy sliding of the piece of furniture over the surface on which it is supported, such as a floor. More specifically, the feet of desks or chairs are designed to increase the amount of surface-area contact and reduce the amount of frictional contact between the legs and the floor.

One type of foot commonly employed in the related art generally includes an attachment portion and a gliding portion. The attachment portion is adapted to be securely attached to the free end of a leg, and the gliding portion is operatively connected to the end of the attachment portion opposite the leg. The gliding portion has a flat surface made of a hard, durable material, such as metal or nylon, and adapted to be in operative contact with the floor.

However, this type of foot suffers from the disadvantage that when the chair or desk is moved along the floor, frictional contact between the foot and the floor produces a perceptible noise. In a classroom setting, especially in an elementary school where many relatively young students can be moving or "scooting" their respective chairs and desks at any one time, this noise can be multiplied to a very significant level. Also, this type of foot suffers from the disadvantage that the flat surface collects sand, dirt, and other debris. Furthermore, this type of foot suffers from the disadvantage that the flat surface can produce rust marks on the floor. In addition, a tool is often required to attach/remove this type of foot to/from the leg. Moreover, this type of foot suffers from the disadvantage that the angle at which the flat surface of the gliding portion operatively contacts the floor may be different from chair to chair, for instance, depending upon the relationship of each leg of the chair with the floor. As such, only a portion of the flat surface may actually operatively contact the floor.

To overcome these disadvantages in the related art, educators and maintenance personnel have sometimes employed tennis balls as makeshift glides for the legs of chairs and desks. An open-ended hole is cut in a tennis ball to accommodate the free end of a leg. While ingenious, this approach has been deemed objectionable as unsightly and unprofessional. Also, this type and other similarly shaped types of glide suffer from the disadvantage that they are not fixedly secured to the free end of the leg. As a result, when the chair or desk is moved along the floor, the amount of frictional contact between the glide and the free end may not be sufficient to retain the glide in place about the free end. In fact, as the chair or desk is moved, the glide can slide down the free end of the leg such that the glide can even slide off the leg. Furthermore, in a classroom setting, especially in an elementary school, the relatively young students can manually remove the glides. In either event, at least one missing glide from a chair or desk can cause the respective chair or desk to wobble and, thus, be functionally inferior. In addition, glides of any type made of a hard, durable rubber can grind into and, thus, mar the floor over which the chair or desk is slid.

Thus, there is a need in the related art for a glide that can be fixedly secured to the free end of a leg of a piece of furniture such that it can be retained about the leg when the piece of furniture is moved along a floor while maintaining sufficient contact with the floor. Similarly, there remains a need in the art for a glide that cannot be manually removed from the leg by relatively young students in a classroom setting, especially in an elementary school. There is also a need in the related art for a glide that does not mar the floor or produce a perceptible noise or rust marks on the floor when the piece of furniture is moved along the floor. There is also a need in the related art for a glide that does not require a tool to securely fasten the glide to the leg. There is also a need in the related art for a glide that is not unsightly and unprofessional.

SUMMARY OF THE INVENTION

The invention overcomes the disadvantages in the related art in a glide assembly adapted to be mounted to the free end of a leg of a piece of furniture. The glide assembly includes a body defining an exterior and a bore extending partially through the body to define a hollow interior surface and an open end of the body. An insert is removably mountable about the free end of the leg and adapted to be received through the open end and within the bore of the body so as to fixedly secure the body about the free end of the leg.

The furniture glide assembly of the present invention can be fixedly secured to the free end of the leg of the piece of furniture. As a result, the assembly can be retained about the leg when the piece of furniture is moved along a floor while maintaining sufficient contact with the floor. Similarly, the assembly cannot be manually removed from the leg by relatively young students in a classroom setting, especially in an elementary school. Also, the assembly is made of a soft PVC material and, thus, does not mar or produce rust marks on the floor or produce a perceptible noise when the furniture is moved along the floor. Furthermore, a tool is not required to securely fasten the assembly to the leg. In addition, the assembly has a functional yet professional appearance.

Other objects, features, and advantages of the present invention will be readily appreciated as the same becomes better understood after reading the subsequent description taken in conjunction with the accompanying drawings.

DETAILED DESCRIPTION OF THE INVENTION

Figure 1:
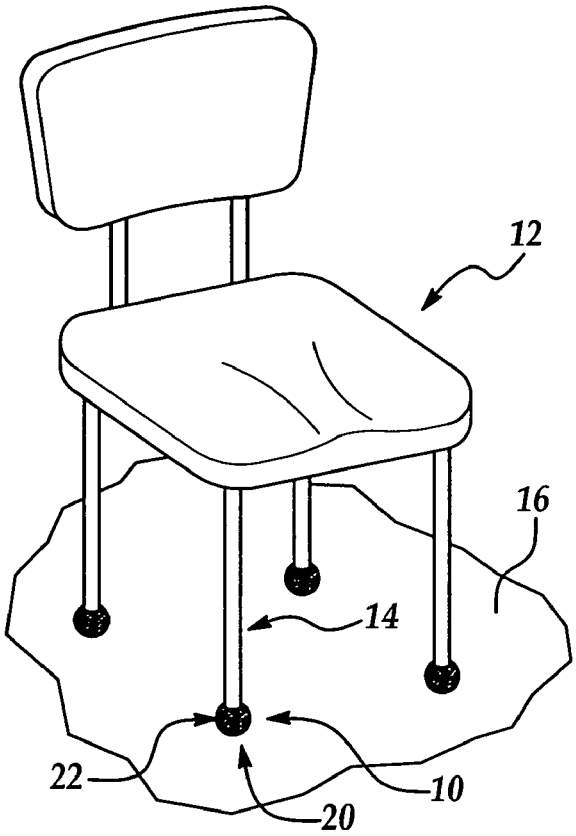
FIG. 1 is an environmental view of a chair showing the furniture glide assembly of the present invention removably mounted about the free end of each of four legs of the chair.
Figure 2:
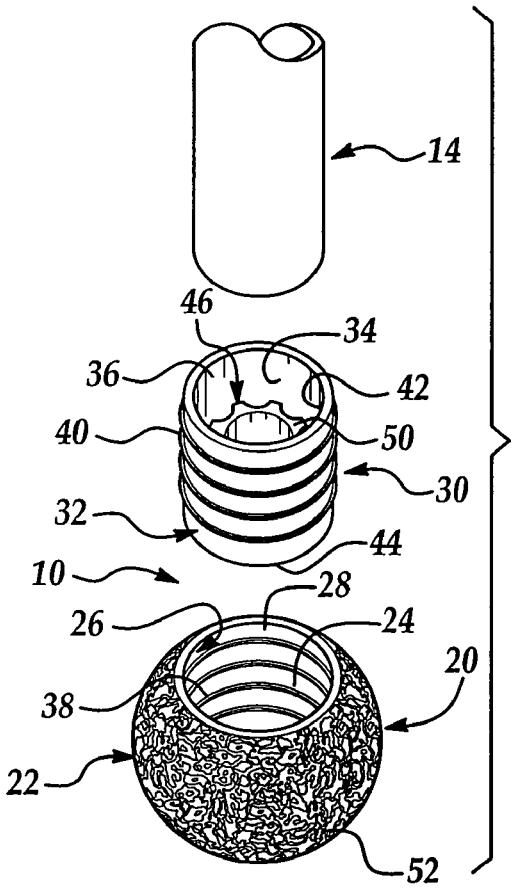
FIG. 2 is an exploded assembly view of the furniture glide assembly of the present invention.
Figure 3:
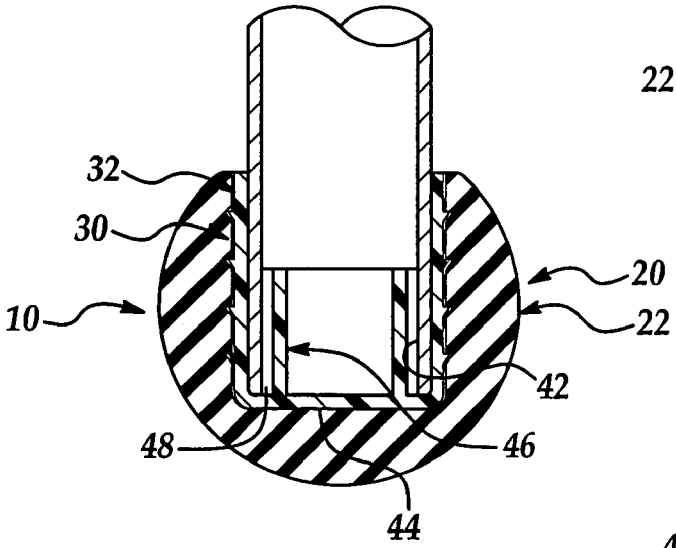
FIG. 3 is a cross-sectional side view of the furniture glide assembly of the present invention.

Referring now to the figures, where like numerals are used to designate like structure, a furniture glide assembly of the present invention is generally indicated at 10 in FIGS. 1 through 3. The assembly 10 is adapted to be mounted about the free end of each leg, generally indicated at 14, of a piece of furniture, generally indicated at 12 in FIG. 1. The piece of furniture 12, in general, and the legs 14, in particular, are adapted to be supported by a surface, such as a floor 16.

The assembly 10 is described below and shown in FIG. 1 used in connection with a chair. However, those having ordinary skill in the related art will appreciate that the assembly 10 can be used in connection with any suitable piece of furniture, such as a desk. Those having ordinary skill in the related art will further appreciate that the assembly 10 can find special application when used in connection with chairs and desks of a classroom.

Referring now to FIGS. 1 through 3, the free end of a leg 14 is substantially cylindrical and relatively narrow. It should be appreciated by those having ordinary skill in the related art that the free end of the leg 14 can be hollow or solid and open-ended or closed-ended. In general, the assembly 10 is adapted to be mounted to the free end of the leg 14. To this end and as shown in FIG. 2, the glide 10 includes a body, generally indicated at 20, defining an exterior, generally indicated at 22, and a bore 24 extending partially through the body 20 to define a hollow interior surface 26 and an open end 28 of the body 20. An insert, generally indicated at 30, is removably mountable about the free end of the leg 14 and adapted to be received through the open end 28 and within the bore 24 so as to fixedly secure the body 20 about the free end of the leg 14.

In a preferred embodiment and as shown in FIG. 2, the body 20 is substantially spherical. The bore 24 extends through nearly the entire body 20 such that the bore 24 is substantially concentric with the body 20. Also, the bore 24 is substantially cylindrical and adapted to be coaxial with the free end of the leg 14.

However, it should be appreciated by those having ordinary skill in the related art that the body 20 can have any suitable arcuate shape and size. It should also be appreciated that the bore 24 can extend any suitable distance into the body 20 and have any suitable structural relationship with respect to the center of the body 20. Similarly, the bore 24 can have any suitable shape and size and structural relationship with respect to the free end of the leg 14 such that the bore 24 can receive the insert 30 so as to fixedly secure the body 20 about the free end of the leg 14.

As shown in FIG. 2, in the preferred embodiment, the insert 30 is substantially cylindrical. The insert 30 defines an exterior, generally indicated at 32, and a passageway 34 extending at least partially through the insert 30 to define a hollow interior 34 and at least one open end 36 of the insert 30. In the embodiment shown, the insert 30 defines a single open end 36. The free end of the leg 14 is adapted to be matingly received through the open end 36 and within the hollow interior 34 of the insert 30 to removably mount the insert 30 about the free end of the leg 14. Also in the embodiment shown, the top of the insert 30 is disposed substantially flush with the top of the body 20.

However, it should be appreciated by those having ordinary skill in the related art that the insert 30 can have any suitable shape and size so as to be receivable through the open end 28 and within the bore 24 of the body 20. For instance, the top of the insert 30 can be disposed any suitable distance above or below the top of the body 20. It should also be appreciated that the passageway 34 can extend any suitable distance through the insert 30, such as entirely through the insert 30 to define two opposed open ends 36 of the insert 30. Similarly, the passageway 34 can have any suitable structural relationship with respect to the insert 30. The passageway 34 can have any suitable shape and size and structural relationship with respect to the free end of the leg 14 so as to receive the free end of the leg 14.

As shown in FIG. 2, the hollow interior surface 26 of the body 20 includes at least one groove 38, and the exterior 32 of the insert 30 includes at least one rib 40 adapted to cooperate with the at least one groove 38 to fixedly secure the body 20 about the insert 30. In the embodiment shown, the hollow interior surface 26 includes four grooves 38, and the exterior 32 of the insert 30 includes four ribs 40 adapted to correspondingly cooperate with the four grooves 38 to fixedly secure the body 20 about the insert 30. The four grooves 38 are substantially equidistantly spaced and disposed substantially parallel with respect to each other and perpendicular to the free end of the leg 14. Also, each groove 38 is disposed substantially entirely about the bore 24 of the body 20, and the corresponding rib 40 is disposed substantially entirely about the exterior 32 of the insert 30.

However, it should be appreciated by those having ordinary skill in the related art that the hollow interior surface 26 of the body 20 can include any suitable number of grooves 38 and the exterior 32 of the insert 30 can include any suitable number of ribs 40 adapted to cooperate with the groove(s) 38 to fixedly secure the body 20 about the insert 30. It should also be appreciated that each groove 38 can have any suitable shape and size and structural relationship with respect to each of any of the other grooves 38, the free end of the leg 14, and the bore 24 of the body 20. In turn, it should also be appreciated that each rib 40 can have any suitable shape and size and structural relationship with respect to each of any of the other ribs 40 so as to cooperate with the groove(s) 38 to fixedly secure the body 20 about the insert 30.

Figure 4:
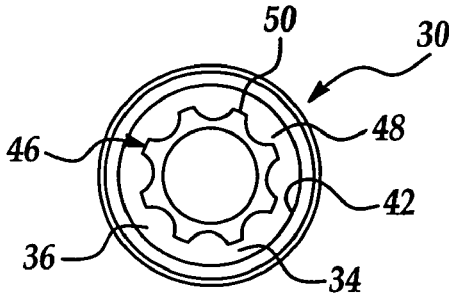
FIG. 4 is a top view of the insert of the furniture glide assembly of the present invention.

For the case in which the free end of the leg 14 is hollow and open-ended to define an interior surface of the free end of the leg 14 and as shown in FIGS. 2 through 4, the hollow interior 34 of the insert 30 defines a hollow interior surface 42 of the insert 30. The passageway 34 of the insert 30 includes at least one closed end 44 located opposite the open end 36 of the insert 30. The insert 30 may also include a post, generally indicated at 46, extending from the closed end 44 toward the open end 36 of the insert 30. As shown in FIGS. 3 and 4, a volume 48 of the passageway 34 is defined about the post 46. The post 46 is adapted to be received through the opening of and within the free end of the leg 14 with the outer surface of the free end of the leg 14 being adapted to be matingly received in the volume 48 between the post 46 and the hollow interior surface 42 of the insert 30 to removably mount the insert 30 about the free end of the leg 14.

In the embodiment shown, the post 46 is substantially cylindrical and coaxial with respect to the passageway 34 such that the volume 48 of the passageway 34 defined about the post 46 is substantially uniform. The post 46 also extends only partially from the closed end 44 toward the open end 36 of the insert 30. However, it should be appreciated by those having ordinary skill in the art that the post 46 can have any suitable shape and size and structural relationship with respect to the passageway 34. It should also be appreciated that the post 46 can extend any suitable distance from the closed end 44 toward the open end 36 of the insert 30 such that the outer surface of the free end of the leg 14 is matingly received in the volume 48 between the post 46 and the hollow interior surface 42 of the insert 30 to removably mount the insert 30 about the free end of the leg 14.

To this end and as shown in FIGS. 2 and 4, the post 46 defines a plurality of ribs 50 extending axially along the post 46. The ribs 50 are adapted to be in abutting contact with the interior surface of the free end of the leg 14 so as to create an interference fit between the ribs 50 and such interior surface and, thus, removably mount the insert 30 about the free end of the leg 14. In the embodiment shown, the ribs 50 are substantially equidistantly spaced about substantially the entire post 46. The ribs 50 are also disposed substantially parallel with respect to each other and the free end of the leg 14 and perpendicular to the ribs 40 of the exterior 32 of the insert 30. Also, each rib 50 is disposed substantially entirely along the post 46.

It should be appreciated by those having ordinary skill in the related art that the post 46 can define any suitable plural number of ribs 50. It should also be appreciated that each rib 50 can extend in any suitable direction with respect to the post 46 so as to be in abutting contact with the interior surface of the free end of the leg 14. The ribs 50 can have any suitable shape and size and structural relationship with respect to each other and the post 46. On the other hand, where the free end of the leg 14 is closed, the insert 30 does not include the post 46.

As shown in FIG. 2, the exterior 22 of the body 20 includes a plurality of raised surfaces 52 adapted to facilitate smooth frictional contact between the assembly 10 and the floor 16 on which the assembly 10 is supported. The raised surfaces 52 are substantially non-uniformly shaped with respect to each other and raised a substantially equal height above the exterior 22 of the body 20, which is only a slight amount relative to the radius of the body 20. The raised surfaces 52 are also substantially in non-contacting relationship with each another. Furthermore, each of the plurality of raised surfaces 52 is substantially smooth.

It should be appreciated by those having ordinary skill in the art that the exterior 22 of the body 20 can include any suitable number of raised surfaces 52 to facilitate smooth frictional contact between the assembly 10 and the floor 16. Similarly, the raised surfaces 52 can have any suitable shape, size, and texture and structural relationship with respect to each other and the body 20.

Referring now to FIG. 3, to mount the assembly 10 to the free end of a leg 14 of the chair 12, the free end of the leg 14 is situated such that it is matingly received through the open end 36 and within the hollow interior 34 of the insert 30 to removably mount the insert 30 about the free end of the leg 14. For the case in which the free end of the leg 14 is hollow and open-ended to define an interior surface, the post 46 is received through the opening of and within the free end of the leg 14 with the outer surface of the free end of the leg 14 being matingly received within the volume 48 and between the post 46 and the hollow interior surface 42 of the insert 30. Then, the bore 24 of the body 20 receives the insert 30 such that each rib 40 of the insert 30 correspondingly cooperates with each groove 38 of the body 20 to fixedly secure the body 20 about the insert 30 and, thus, free end of the leg 14. The process can then be repeated for each of the remaining legs 14 of the chair 12. It should be appreciated by those having ordinary skill in the related art that the assembly 10, in general, and the body and insert 20, 30, respectively, in particular, can be designed to cooperatively receive a free end of a leg of any suitable size, shape, and structure.

Preferably, the insert 30 is made of nylon, and the body 20 is made of a soft PVC material. However, it should be appreciated by those having ordinary skill in the related art that the insert 30 can be made of any suitable material and the body 20 can be made of any suitable soft material such that it does not mar the floor 16. Also, the exterior 22 of the assembly 10 is smooth. However, the exterior 22 of the assembly 10 can have any suitable texture such that frictional contact between the assembly 10 and the floor 16 does not produce a perceptible noise and rust marks on the floor 16 when the chair 12 is moved along the floor 16. Furthermore, the exterior 22 of the assembly 10 can be any suitable color and have any suitable color combination so as to have a desired aesthetic appeal.

The assembly 10 can be fixedly secured to the free end of a leg 14 of a piece of furniture 12. As a result, the assembly 10 can be retained about the leg 14 when the piece of furniture 12 is moved along a floor 16 and sufficiently contact the floor 16. Similarly, the assembly 10 cannot be manually removed from the leg 14 by relatively young students in a classroom setting, especially in an elementary school. Also, the assembly 10 is made of a soft PVC material and, thus, does not mar the floor 16 or produce a perceptible noise or rust marks on the floor 16 when the piece of furniture 12 is moved along the floor 16. Furthermore, a tool is not required to securely fasten the assembly 10 to the leg 14. In addition, the assembly 10 is not unsightly and unprofessional.

The present invention has been described in an illustrative manner. It is to be understood that the terminology that has been used is intended to be in the nature of words of description rather than of limitation. Many modifications and variations of the present invention are possible in light of the above teachings. Therefore, within the scope of the appended claims, the present invention may be practiced other than as specifically described.

What is claimed is:

1. A glide assembly adapted to be mounted to the free end of a leg of a piece of furniture, said glide assembly comprising:

a substantially spherical body defining an exterior and a bore extending partially through said body to define a hollow interior surface and an open end of said body; and an insert removably mountable about the free end of the leg and adapted to be received through said open end and within said bore of said body so as to fixedly secure said body about the free end of the leg, wherein said insert defines an exterior, said hollow interior surface of said body includes at least one groove, and said exterior of said insert includes at least one rib adapted to cooperate with said at least one groove to fixedly secure said body about said insert;

wherein said insert has a passageway extending partially through said insert to define a hollow interior defining an interior surface of said insert, an open end of said insert, and a closed end located opposite said open end of said insert, said insert including a post extending from said closed end toward said open end of said insert and adapted to be received through an opening of and within the free end of the leg with the free end of the leg being adapted to be matingly received between said post and said interior surface of said insert, said post defining a plurality of ribs extending axially therealong and adapted to be in abutting contact with an interior surface of the free end of the leg to removably mount said insert about the free end of the leg.

2. A glide assembly as set forth in claim 1, wherein said hollow interior surface of said body includes a plurality of grooves and said exterior of said insert includes a plurality of ribs adapted to correspondingly cooperate with said plurality of grooves to fixedly secure said body about said insert.

3. A glide assembly as set forth in claim 2, wherein said plurality of grooves are substantially equidistantly spaced and disposed substantially parallel with respect to each other.

4. A glide assembly as set forth in claim 1, wherein said exterior of said body includes a plurality of raised surfaces adapted to facilitate smooth frictional contact between said glide assembly and the surface on which said glide assembly is supported.

5. A glide assembly as set forth in claim 4, wherein said plurality of raised surfaces are substantially non-uniformly shaped with respect to each other.

6. A glide assembly as set forth in claim 4, wherein said plurality of raised surfaces are raised a substantially equal height above said exterior of said body.

7. A glide assembly as set forth in claim 4, wherein each of said plurality of raised surfaces is substantially smooth.

8. A glide assembly as set forth in claim 1, wherein said insert is made of plastic.

9. A glide assembly as set forth in claim 1, wherein said body is made of a soft PVC material.

* * * * *